US005526745A

United States Patent [19]

Uera

[11] Patent Number: 5,526,745

[45] Date of Patent: Jun. 18, 1996

[54] PUMP UNIT FOR PRINTING MACHINE

[75] Inventor: Yoshinori Uera, Kanagawa-ken, Japan

[73] Assignee: Kabushiki Kaisha Tokyo Kikai Seisakusho, Japan

[21] Appl. No.: 389,940

[22] Filed: Feb. 17, 1995

[30] Foreign Application Priority Data

May 31, 1994 [JP] Japan ..... 6-118217

[51] Int. Cl.[6] ..... B41F 31/08; B41F 31/06

[52] U.S. Cl. ..... 101/366

[58] Field of Search ..... 101/366, 365, 101/350, 363, 207–210, DIG. 45, DIG. 47; 417/286, 426, 2, 62

[56] References Cited

U.S. PATENT DOCUMENTS 3,366,051 1/1968 Fusco ..... 101/365

5,168,807 12/1992 Elia et al. ..... 101/366

*Primary Examiner*—J. Reed Fisher

*Attorney, Agent, or Firm*—Ronald P. Kananen

[57] ABSTRACT

A pump unit for a printing machine comprises a base member and a plurality of pumps incorporated in the base member. Each of the pumps comprises a cylinder mounted to the base member and provided with a main bore closed at one end thereof and extending in an axial direction of the cylinder member and with suction and discharge ports, a plunger fitted in the main bore of the cylinder so as to always close another end of the main bore and to be reciprocal and rotatable therein, a variable speed motor mounted to the base member having an output shaft, and a transmission mechanism disposed between the plunger and the variable speed motor for transmitting an output of the variable speed motor to the plunger member. The transmission mechanism comprises an arm member mounted to the output shaft of the variable speed member and a connection member coupled at one end to the plunger member and at another end to the arm member through a spherical bearing. The plunger is formed with a cutout to an insertion end of the plunger so that the suction and discharge ports are both closed together at two portions different by a half rotation in its rotational phase, and either one of the suction port and the discharge port is alternately communicated with the main bore through the cutout at another two portions except for said two portions in its rotation phase, and the connection member has a center axis intersecting the rotation center axis of the plunger and the rotation center axis of the output shaft so that the intersection angle of the center axis of the connection member with the rotation center axis of the plunger is always constant and the intersection angle of the center axis of the connection member with the rotation center axis of the output shaft is variable.

8 Claims, 3 Drawing Sheets

PUMP UNIT FOR PRINTING MACHINE

BACKGROUND OF THE INVENTION

The present invention relates to a pump unit particularly for a printing machine utilized for supplying a printing ink in the printing machine.

There have been proposed various pumps for printing machines for the utilization disclosed, for example, in the Japanese Patent Publication No. SHO 45-85447, and the pump unit for the printing machine of the present invention is one of the improvement of that disclosed in this prior art publication.

SUMMARY OF THE INVENTION

An object of the present invention is to substantially eliminates defects or problems encountered in the prior art described above and to provide a pump assembly for a printing machine capable of, when the pump is for example used for supplying an ink, stopping the operation of a plunger of a certain pump of the pump assembly which is not required to discharge the ink, preventing the friction of such plunger and cylinder and the generation of heat of the plunger, capable of reducing the generation of noise during the operation of the pump and reducing the transmission loss, capable of making compact the structure of the mechanism of the pump, reducing frequency of causing any fault or inconvenience which results in easy maintenance and remedy are capable if any fault is caused, and also capable of minimally reducing remaining ink in the pump even in a printing machine which requires frequently the changing of inks.

This and other objects can be achieved according to the present invention by providing a pump unit for a printing machine comprising:

a base member and a plurality of pumps incorporated in the base member, each of the pumps comprising:

a cylinder member mounted to the base member and provided with a main bore closed at one end thereof and extending in an axial direction of the cylinder member and with suction port and discharge port having center axes crossing a center axis of the main bore in a same plane;

a plunger member fitted in the main bore of the cylinder member so as to always close another end of the main bore and to be reciprocal and rotatable therein;

a variable speed motor, for example, a stepping motor, mounted to the base member, the variable speed motor having an output shaft having a center axis intersecting a rotation center axis of the plunger member at a predetermined angle; and a transmission mechanism disposed between the plunger member and the variable speed motor for transmitting an output of the variable speed motor to the plunger member, the transmission mechanism comprising an arm member mounted to the output shaft of the variable speed motor and having a portion projecting toward the plunger member and being apart from the rotation center axis of the output shaft, and a connection member coupled at one end to the plunger and at another end to the arm member through a spherical bearing, wherein the plunger member is formed with a cutout to an insertion end of the plunger so that the suction port and the discharge port are both closed together at two portions of an outer periphery of the plunger member different by a half rotation in its rotational phase, and either one of the suction port and the discharge port is alternately communicated with the main bore through the cutout at another two portions except for the two portions in its rotation phase, and wherein the connection member has a center axis intersecting the rotation center axis of the plunger member and the rotation center axis of the output shaft so that the intersection angle of the center axis of the connection member with the rotation center axis of the plunger member is always constant and the intersection angle of the center axis of the connection member with the rotation center axis of the output shaft is variable.

The cutout of the plunger is positioned so that the suction port and the discharge port are both together closed by the periphery of the plunger member at the two portions in the rotation phase, the connection member is disposed so that the intersection angles of the center axis thereof with the rotation center axis of the output shaft takes maximum and minimum angles. The plunger member is reciprocated by one reciprocal motion while being rotated by one rotation in response to one rotation of the variable speed motor.

A detection means such as proximity switch may be disposed so as to face a rotating area of the arm member rotated by the variable speed motor for detecting the movement of the arm member.

An electroless plating process may be effected to mutually slidably fitted surfaces of the cylinder member and the plunger member.

The base member has a portion opened outward at a lower portion thereof on another side of the main bore of the cylinder member.

According to the structures and characters of the pump unit of the present invention described above, since the variable speed motor for driving the arm member is disposed so that the rotation center axis of the output shaft of the variable speed motor intersects the rotation center axis of the plunger with a predetermined angle, when the arm member is rotated by the variable speed motor, the coupling position of the arm member to the connection member is displaced along the rotation center of the plunger.

The connection member has a center axis intersecting the rotation center axis of the plunger and the rotation center axis of the output shaft so that the intersection angle of the center axis of the connection member with the rotation center axis of the plunger is always constant and the intersection angle of the center axis of the connection member with the rotation center axis of the output shaft is variable. Accordingly, when the connection member is slid in parallel to its axis at either one connection portion to the plunger or arm member, the displacement of the coupled portion between the arm member and the connection member is transmitted to the plunger thereby to cause the reciprocal motion to the plunger in a direction parallel to the rotation center axis thereof, and the rotation of the variable speed motor is also transmitted to the plunger to rotate the same.

That is, the plunger is reciprocated by one reciprocal motion while being rotated by one rotation in response to one rotation of the variable speed motor, and when the plunger is positioned at both dead points of the reciprocal motion, the suction and discharge ports for fluid are simultaneously closed by the peripheral portion of the plunger, whereas when the plunger is moved towards one side of the cylinder bore, the discharge port is communicated with the cylinder bore through the cutout formed to the plunger and when the plunger is moved towards the other side of the cylinder bore, the suction port is communicated with the cylinder bore through the cutout.

According to such motion of the plunger, the suction of the fluid into the cylinder bore through the suction port and the discharge thereof through the discharge port are performed in repeated manner, and furthermore, the operation speed of the plunger is changed in response to the revolution number per unit time of the variable speed motor and the discharge amount of the fluid is hence changed per unit time.

When the pump unit of the characters described above is applied as an ink pump of a printing machine, the conventional problems can be overcome.

That is, since the plunger is driven through the transmission mechanism by the variable speed motor mounted to the base member, the operation of the plunger is stopped by stopping the operation of the variable speed motor when a pump requiring no ink discharging is used, thus preventing unnecessary mutual friction between the plunger and the cylinder into which the plunger is slidably fitted and also preventing the heat generation of the pump due to such friction, and accordingly, the use life of the pump can be elongated. Furthermore, in the pump unit in which a plurality of pumps are assembled, the heat generated to one pump does not adversely affect on the adjacent pump. The transmission mechanism is not provided with any gear mechanism, so that the generation of noises during the pump operation can be effectively prevented and the transmission loss is possibly reduced. Further, a structure in which the operation of the variable speed motor is stopped by interrupting an electrical conduction to the motor will save energy use.

Furthermore, since the mechanism is made simplified by eliminating a mechanism for adjusting the reciprocal displacement of the plunger, generation of fault or the like can be reduced in frequency and easy maintenance and remedy of fault can be realized. In addition, the constant reciprocal displacement of the plunger makes it possible to minimize the ink to be stored in the cylinder bore, and accordingly, for a printing machine requiring frequent color change operations, an amount of useless ink in the cylinder bore can be reduced minimally. Still furthermore, since the adjustment of the discharge amount of the ink can be done by changing the operation speed of the variable speed motor, the ink discharge amount can be adjusted relatively wide allowance, and when a stepping motor is used as such variable speed motor, an excellent reproductivity of the operation speed can be achieved and, hence, the reproductivity of the ink discharge amount can be also precisely realized.

Moreover, the location of the detection means for detecting the motion of the arm member may check the desired operation of the plunger to which the arm member is operatively connected and also check the desired operation of the pump itself, thereby maintaining the stable operation of the printing machine to produce printed materials with high qualities, and the location of the detection means may also prevent the damage of the mechanical parts of the pump due to the overload of the variable speed motor.

Furthermore, the nickel plating on the sliding surfaces of the plunger and the cylinder will improve the chemical corrosion resistant property and the mechanical abrasion resistant property, thus improving the durability of the plunger and the cylinder, hence, the pump itself. By the electroless nickel plating process, the plated layer can be uniformly formed in accordance with the shapes of the plunger and the cylinder, thus improving the surface finishing performance.

Still furthermore, since the base member is provided with an opened lower portion on the rear side of the cylinder bore, even if an ink leaks through the cylinder bore, the ink is flowed out through this opened portion and can be treated at the outside of the base member, and any fault or inconvenience caused to the structural members or parts of the pump by the storage of the leaking ink in the pump, for example, revolution irregularity of the arm member, rough sliding of the connection member and rough operation of the spherical bearing, in result irregular operations of pumps and damage of the variable speed motor by over loading, can be preferably avoided.

The nature and further features of the present invention will be made more clear from the following description made in conjunction with the accompanying drawings.

DESCRIPTION OF THE PREFERRED EMBODIMENT

Figure 1:
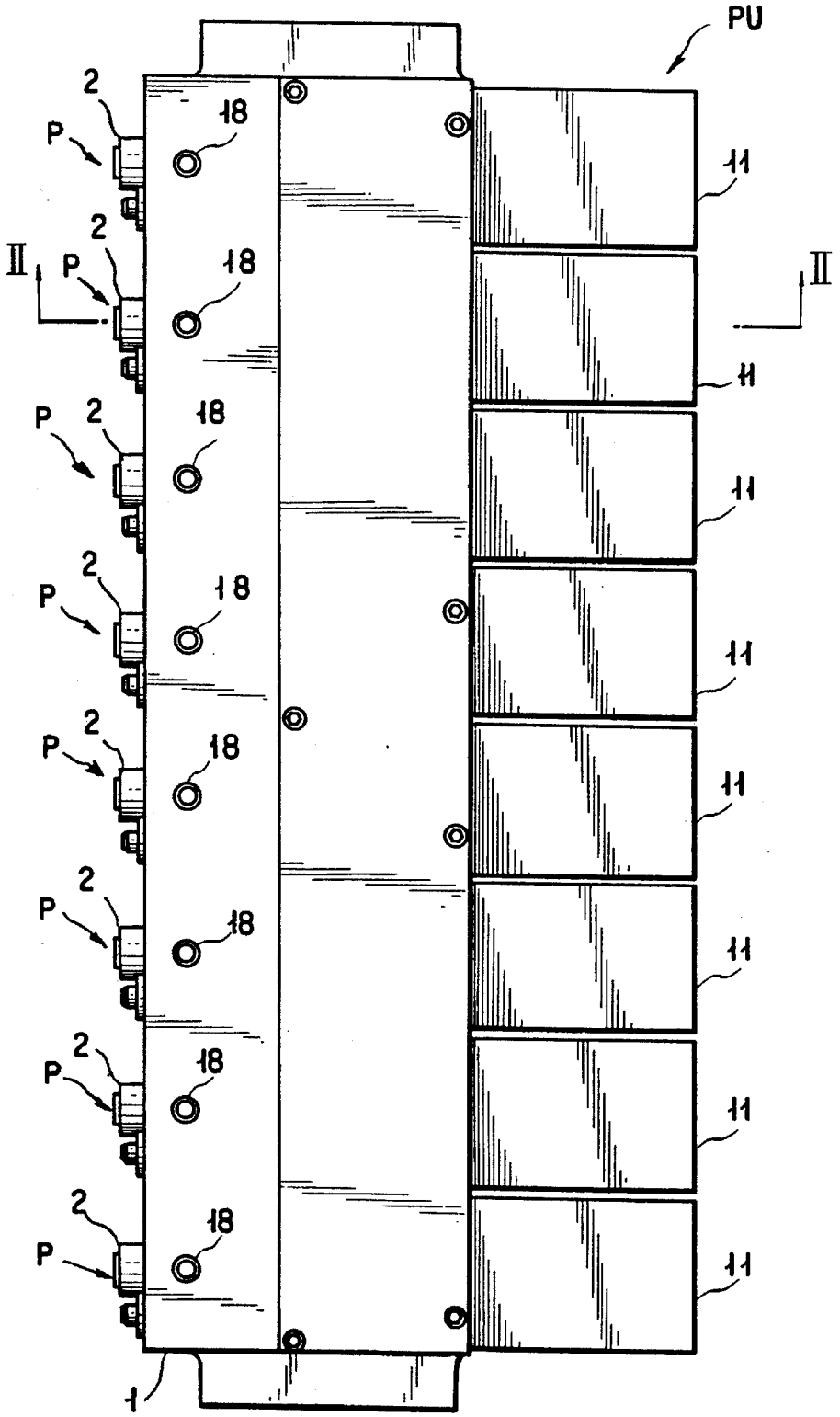
FIG. 1 is an illustrated plan view of a pump unit according to the present invention in which eight pumps are incorporated in a base table.
Figure 2:
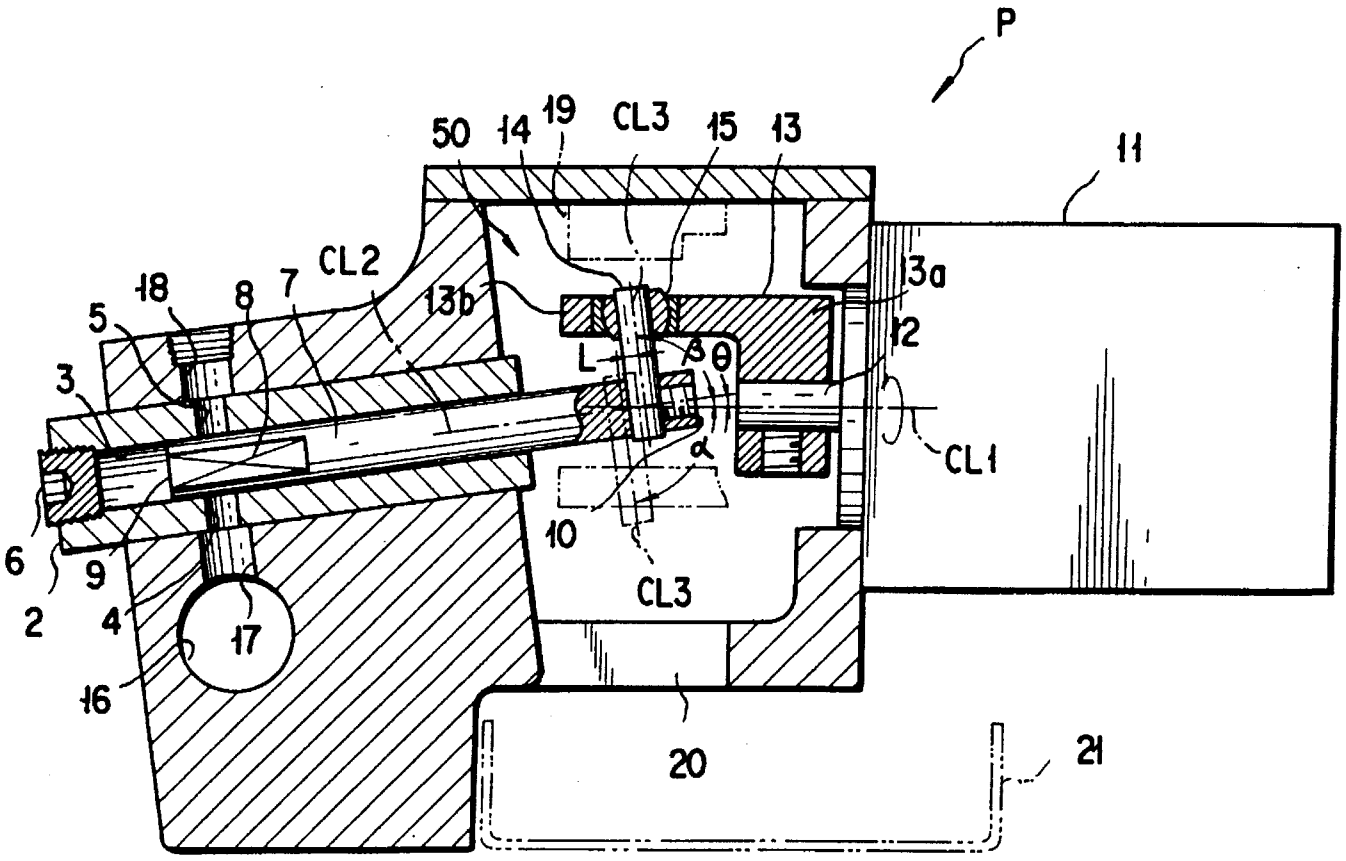
FIG. 2 is a sectional view taken along the line II—II in FIG. 1.
Figure 3:
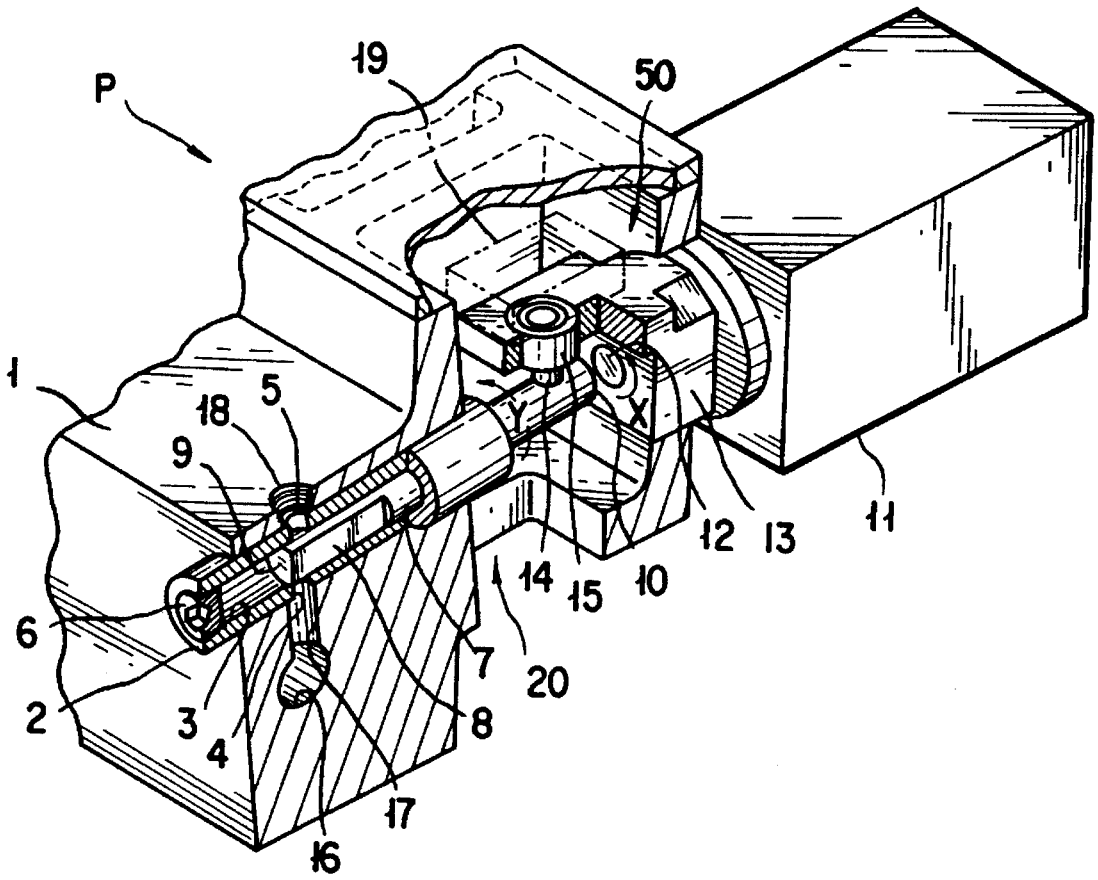
FIG. 3 is a perspective view, partially broken away, of the pump unit of FIG. 1 or 2.

FIG. 1 is a plan view showing a pump unit PU for supplying an ink, for example, in a printing machine, the pump unit PU being provided with eight (8) pumps P incorporated in a base table 1, FIG. 2 is a sectional view taken along the line II—II in FIG. 1, and FIG. 3 is a perspective view, in an enlarged scale, partially broken away, of a main portion of the pump unit shown in FIG. 2.

Referring to FIGS. 1 to 3, each pump P is provided with a cylinder 2 mounted to one side of the base table 1 and a plunger 7 fitted into a main bore 3 of the cylinder 2 to be reciprocal and rotatable.

The main bore 3 of the cylinder 2 has one (front) end closed by a plug 6 and is formed of two through holes, that is, a suction port 4 and a discharge port 5 in a vertical alignment as viewed in FIG. 2. The center axes of both ports intersect the center axis of the main bore 3. The suction port 4 is communicated with an ink tank, not shown, as a fluid supply source, through fluid passages 16 and 17 and the discharge port 5 is also communicated with an ink rail, not shown, as a portion to which the ink is supplied, through a fluid passage 18, these fluid passages 16, 17 and 18 being formed to the base table 1.

The plunger 7 is formed with a cutout 8 to an outer peripheral portion thereof being always fitted with the main bore 3 of the cylinder 2 so as to extend to a front end 9 of the fitting, i.e. insertion, side end closed by the plug 6. The cutout 8 communicates the front end space of the bore 3 mutually with the suction port 4 and the discharge port 5 every half rotation of the plunger 7 in the cylinder bore 3 and when the plunger 7 is at a rotating position not facing these ports 4 and 5, the ports 4 and 5 are both simultaneously closed by the outer peripheral surface of the plunger 7.

In the illustrated present embodiment, nickel (Ni) layers are formed by means of electroless plating process on mutual sliding surfaces of the cylinder 2 and the plunger 7 fitted in the cylinder 2 thereby to provide chemical corrosion resistant property and mechanical strength such as abrasion resistant property.

To the other (rear) side of the base table 1, there is fixedly mounted a variable speed motor 11 through a space for locating a transmission mechanism 50 in a manner such that the rotation center axis CL1 of an output shaft 12 of the variable speed motor 11 intersects the rotation central axis CL2 of the plunger 7 in the cylinder bore 3 at a predetermined intersection angle θ. In the illustrated embodiment, the variable speed motor 11 is a stepping motor which is driven by a motor driver, not shown, and which is selectively controlled properly to a revolution number per unit time.

The transmission mechanism located in the above space 50 is one adapted to reciprocate and rotate the plunger 7 in response to the rotational operation of the variable speed motor 11. The transmission mechanism 50 comprises an arm member 13 having a base portion 13*a* fixed to the output shaft 12 of the variable speed motor 11 and a projected arm portion 13*b*. The transmission mechanism 50 also comprises a connection member 14 connecting a free end of the arm member 13, i.e. projected arm portion 13*b*, and the rear end 10, right side end as viewed in FIG. 2, of the plunger 7. The arm member 13 projects forward from a portion of the base portion 13*a* apart from the rotation center axis CL1 of the output shaft 12 in a direction substantially parallel thereto so as not to interfere with the rear end 10 of the plunger 7 fitted in the cylinder bore 3.

The connection member 14 has one end connected to the plunger 7 in a condition that the center axis CL3 of the connection member 14 intersects the rotation center axis CL2 of the plunger 7 always at a predetermined angle, for example 90°, in the illustrated embodiment, and has another end is coupled to the projected arm portion 13*b* of the arm member 13 through a spherical bearing 13 so that a coupling angle is freely variable, that is, the intersection angle of the axis CL3 with respect to the axis CL1 of the output shaft 12 of the variable speed motor 11 is freely variable (angle α to β in the illustrated embodiment). The connection member 14 is connected to be slidable in a direction parallel to the axis CL3 at either one of the coupled portions to the plunger 7 or arm member 13, and in the illustrated embodiment, the connection member 14 is coupled to be slidable in the direction parallel to the axis CL3 at the coupling portion to the arm member 13.

This intersection angle between the center axis CL3 of the connection member 14 and the center axis CL1 of the output shaft 12 is determined such that this crossing angle becomes maximum (α) or minimum (β) at a time when the plunger 7 takes two rotation phase positions simultaneously closing the suction port 4 and the discharge port 5.

The arrangement of the both ports 4 and 5 and the cutout 8 has a relation such that both the suction port 4 and discharge port 5 are closed together when one reciprocal motion of the plunger 7, which is carried out by one rotation of the variable speed motor 11, takes both dead points, and otherwise, when the plunger 7 is moved from one (front) end side towards the other (rear) end side of the cylinder bore 3, the suction port 4 is communicated with the deep side of the cylinder bore 3 by means of the cutout 8 and when moved from the other side to the one side, the discharge port 5 is communicated with the deep side of the cylinder 2 by means of the cutout 8.

Further, in the space in which the transmission mechanism 50 is disposed, a detecting means 19 for detecting the position of the arm member 13 may be disposed in a manner such that the detecting means 19 faces the rotation area of the arm member 13 as shown two-dots and dash line in FIG. 2 or 3. In the illustrated embodiment, the detecting means 19 may comprise a proximity switch adapted to detect the reaching of the arm member 13 to a close position and transmit a signal representing this close reaching. Furthermore, it may be possible to form a through portion 20 to the base table corresponding to the lower portion of the opening of the cylinder bore 3 on the side of the variable speed motor 11.

The operation of the described embodiment will be explained hereunder.

According to the structure described above, when the variable speed motor 11 is driven by the motor driver, not shown, under the condition shown by the solid line in FIGS. 2 and 3, and the output rotation shaft 12 thereof is rotated in the direction of an arrow X in FIG. 3, the arm member 13 is rotated in the same direction X.

In this instance, the connection member 14 is first slid and displaced in parallel to the axis CL of the connection member 14 while changing the coupling angle at the coupling portion through the spherical bearing 15 between the connection member 14 and the arm member 13, and then displaced from the position shown by the solid line in FIG. 2 to the position shown by the two-dots and dash line.

According to this displacement, the plunger 7 is linearly displaced by a displacement L towards one (front) side of the cylinder bore 3 therealong, and simultaneously, the plunger 7 is also rotated in the direction of an arrow Y in FIG. 3 so that the cutout 8 faces the discharge port 5, thus the discharge port 5 being communicated with the deep side of the cylinder bore 3. Then, the plunger 7 is further rotated by a half rotation to take a position reverse to the state shown in FIG. 3 thereby to close the discharge port 5 by the peripheral surface of the plunger 7. During this rotation of the plunger 7, the suction port 4 is kept closed by the peripheral surface thereof and a fluid in the cylinder port 3 is hence discharged through the discharge port 5.

Successively, the connection member 14 is first slid and displaced in substantially the same manner as that described above at the coupling portion through the spherical bearing 15 between the connection member 14 and the arm member 13, and then displaced to the position shown by the solid line in FIG. 2 from the position shown by the two-dots and dash line.

According to this displacement, the plunger 7 is linearly displaced by a displacement L toward the other (rear) side of the cylinder bore 3 therealong, and simultaneously, the plunger 7 is also rotated in the direction of an arrow Y in FIG. 3 so that the cutout 8 faces the suction port 4, thus the suction port 4 being communicated with the deep side of the cylinder bore 3. Then, the plunger 7 is further rotated by a further half rotation to take a position as shown in FIG. 3, that is, a position reverse to the state shown by the solid line in FIG. 2 thereby to again close the suction port 4 by the peripheral surface of the plunger 7. During this rotation of the plunger 7, the discharge port 5 is kept closed by the peripheral surface thereof and a fluid in the cylinder port 3 is hence sucked into the cylinder bore 3 through the suction port 4.

These operations are performed every one rotation of the variable speed motor 11 and, hence, the fluid is sucked and discharged alternatively in and from the cylinder bore 3. Accordingly, the frequencies of the suction and discharge per unit time can be changed in relatively wide ranges by changing the revolutions per unit time of the variable speed motor 11, and hence, the discharge amount of the fluid per unit time can be also changed in a relatively wide range.

Furthermore, in a case where the variable speed motor 11 is a stepping motor as shown in the illustrated embodiment, the revolution number thereof is controlled by pulse signals, that is, by digital control means, so that the control extremely superior in the reproductivity can be performed, thus being useful for a pump for a printing machine.

On the other hand, in the case where the detecting means 19 is provided, it is possible to detect and check whether the arm member 13 performs the rotational displacement or not, and according to such 13, it becomes also possible to check whether the plunger 7 is actually operated or not, which results in the earlier discovery of the operational abnormal condition of the pump P and the overloading of the variable speed motor 11 in association with this operational abnormality, thus being convenient.

Furthermore, in the case where the opened portion 20 is provided for the base table 1 at the lower portion of the opening of the main bore 3 of the cylinder 2, the fluid leaking through this through portion 20 can be led outside the pump P and then recovered by, for example, the pan 21, even in a case where the fluid in the cylinder bore 3 leaks through the other (rear) side thereof, thus easily treating such accident.

In the embodiment illustrated in FIG. 1, the pump unit PU is equipped with eight pumps P incorporated in the single base table 1. When such pump unit PU is utilized for an ink supply pump unit for a printing machine, a printing surface is sectioned in parallel to the moving direction of a material, such as paper, cloth, film, etc., to be printed, and the ink is supplied to every section of the material to be printed by corresponding one pump, thus being compact and advantageous.

It is of course to be noted that the present invention is not limited to the described embodiment and many other changes and modifications may be made without departing from the scopes of the appended claims of the present invention.

What is claimed is:

1. A pump unit for a printing machine comprising:

a base member; and a plurality of pumps incorporated in said base member;

each of said pumps comprising:

a cylinder member mounted on said base member and provided with a main bore which is closed at a first end thereof, which is opened at a second end thereof, and which extends in an axial direction of the cylinder member, said cylinder member having a suction port and a discharge port having respective center axes which intersect a center axis of the main bore in a common plane;

a plunger member disposed in the main bore of said cylinder member so as to constantly close the second end of the main bore and so as to be reciprocal and rotatable therein;

a variable speed motor mounted on said base member, said variable speed motor having an output shaft having a center axis which intersects an axis of rotation of said plunger member at a predetermined angle; and a transmission mechanism disposed between and interconnecting said plunger member and said variable speed motor for transmitting an output of the variable speed motor to the plunger member, said transmission mechanism comprising:

an arm member mounted on the output shaft of said variable speed motor, the arm member having a portion projecting towards the plunger member which is spaced apart from the rotation center axis of the output shaft, and a connection member coupled at one end to said plunger member and at another end to said arm member through a spherical bearing; and wherein said plunger member is formed with a cutout at an insertion end thereof so that the suction port and the discharge port are both closed together by a portion of an outer periphery of the plunger member during two predetermined phases of the rotation of said plunger, and said suction port and said discharge port are alternately communicated with the main bore through the cutout between the two predetermined rotational phases, wherein said connection member has a center axis intersecting the rotation center axis of said plunger member and the rotation center axis of said output shaft so that the intersection angle of the center axis of the connection member with the rotation center axis of said plunger member is always constant, and the intersection angle of the center axis of the connection member with the rotation center axis of said output shaft is variable, and wherein said base member has an opening at a lower portion thereof proximate and below the second end of the main bore of the cylinder member so as to drain ink leaking from the second end of the main bore from the pump.

2. The pump unit according to claim 1, wherein said center axis of the main bore is inclined at an angle with respect to horizontal so that the first end of the main bore is lower than the second end thereof.

3. The pump unit according to claim 2, wherein when said cutout of the plunger member is positioned so that the suction port and the discharge port are both together closed by the periphery of the plunger member at the two portions in the rotation phase, said connection member is disposed so that the intersection angles of the center axis thereof with the rotation center axis of said output shaft takes maximum and minimum angles.

4. The pump unit according to claim 3, wherein said plunger member is reciprocated by one reciprocal motion while being rotated by one rotation in response to one rotation of said variable speed motor and wherein said suction and discharge ports are both closed at a time when said plunger member is positioned at both dead points of the one reciprocal motion thereof and either one of said suction port and said discharge port is alternately communicated with the main through the cutout at another two portions except for said both dead points in its rotation phase.

5. The pump unit according to claim 2, wherein a detection means is disposed so as to face a rotating area of said arm member rotated by said variable speed motor for detecting the movement of said arm member.

6. The pump unit according to claim 5, wherein said detection means is a proximity switch for detecting approach of the arm member.

7. The pump unit according to claim 2, wherein an electroless plating is effected to mutually slidably fitted surfaces of said cylinder member and said plunger member.

8. The pump unit according to claim 2, wherein said variable speed motor is a stepping motor.

* * * * *